US006416943B1

(12) United States Patent
Romanet et al.

(10) Patent No.: US 6,416,943 B1
(45) Date of Patent: Jul. 9, 2002

(54) COLOR PHOTOGRAPHIC ELEMENT CONTAINING COUPLER USEFUL FOR FORMING NEUTRAL SILVER-BASED IMAGE

(75) Inventors: Robert F. Romanet; Susan D. Hill, both of Rochester; Stephen P. Singer, Spencerport; Anabisdally I. Bodden, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 50 days.

(21) Appl. No.: 09/712,426

(22) Filed: Nov. 14, 2000

(51) Int. Cl.[7] ..... G03C 1/08; G03C 7/26; G03C 7/32

(52) U.S. Cl. ..... 430/553; 430/502; 430/503; 430/512; 430/543; 430/555; 430/557; 430/558; 430/955; 430/449

(58) Field of Search ..... 430/502, 503, 430/512, 543, 544, 553, 555, 557, 558, 955, 449

(56) References Cited

U.S. PATENT DOCUMENTS

| | | | |
|---|---|---|---|
| 3,705,801 | A | 12/1972 | Holtz |
| 3,715,208 | A | 2/1973 | Lestina et al. |
| 3,737,312 | A | 6/1973 | Baptista et al. |
| 3,869,287 | A | 3/1975 | Sakai et al. |
| 5,023,275 | A | 6/1991 | Amick |
| 5,118,681 | A | 6/1992 | Amick et al. |
| 5,151,447 | A | 9/1992 | Amick |

FOREIGN PATENT DOCUMENTS

| | | |
|---|---|---|
| EP | 0 410 726 | 9/1993 |
| GB | 1 504 908 | 3/1978 |

*Primary Examiner*—Geraldine Letscher
(74) *Attorney, Agent, or Firm*—Arthur E. Kluegel

(57) ABSTRACT

The invention provides a color photographic element suitable for forming both a colored dye image and a neutral silver-based image, comprising a support bearing at least one light-sensitive silver halide emulsion layer containing a coupler capable of forming a colored dye upon development, and bearing a further light-sensitive silver halide emulsion layer containing a coupler which is capable of releasing a thiovinyl group upon development that is capable of reacting to form a neutral silver-based image.

19 Claims, No Drawings

COLOR PHOTOGRAPHIC ELEMENT CONTAINING COUPLER USEFUL FOR FORMING NEUTRAL SILVER-BASED IMAGE

FIELD OF THE INVENTION

This invention relates to color photographic materials capable of forming a neutral silver-based image. In particular, it relates to color photographic elements capable of forming a color image and additionally comprising a light sensitive silver halide emulsion layer containing a coupler that forms a neutral silver-based image upon processing.

BACKGROUND OF THE INVENTION

Color photographic elements are those that depend on the presence of colored dye or dyes to produce an image. The image may be multicolor, single color, or neutral due to balancing of the image dyes. Color photographic elements are processed using so-called developers that react with the color couplers present in the element to form the colored dye image. Black and white developers that form a silver image are not suitable as color developers.

Motion picture print film, the film that is shown in movie theaters, commonly employs an optical analog soundtrack along an edge of the film. During projection of the motion picture images, a light source illuminates the analog soundtrack and a photosensor senses the light passing through and modulated by the soundtrack to produce an audio signal that is sent to amplifiers of the theater sound system. While the most common soundtracks are of the "variable area" type wherein the signal is recorded in the form of a varying ratio of opaque to relatively clear area along the soundtrack, "variable density" soundtracks are also known wherein the absolute density is uniformly varied along the soundtrack. Common sound systems incorporate a photodiode in the projector whose radiant sensitivity peaks at approximately 800–1000 nm (depending on the type of photodiode), which detects the predominant infra-red (IR) radiation emitted by common tungsten lamps.

Color photographic films having an auxiliary metallic silver image are well known, for example see French Patent No. 912,605. The auxiliary silver image is useful for optically recording a sound track since silver is opaque to electromagnetic radiation in the range of 800–1000 nm whereas photographic dyes are generally transparent in this region. This allows a detector to read the silver image in the presence of a dye image. However, developed silver and residual silver halide must still be removed from the colored image portion of the film while at the same time, the silver image representing the sound track must be retained. A number of methods have been devised to retain the silver sound track image while still allowing for the removal of the unwanted silver; for example, see U.S. Pat. Nos. 1,973,463, 2,113,329, 2,263,019, 2,243,295, 2,286,747, 2,143,787, 2,258,976 and 2,235,033. A dye soundtrack may also be formed in color motion picture film in accordance with conventional exposing and color development processing. Such dye soundtracks may be formed in multiple photosensitive emulsion layers of the motion picture film, or may be restricted to a single emulsion layer as set forth in U.S. Pat. No. 2,176,303. These all suffer from the disadvantage that some portions of the film require a special and separate treatment relative to other portions of the film. The silver image may be reformed selectively in the soundtrack area of the film through selective application of a second developer solution after initial uniform color development (which develops exposed silver halide in both the picture area and soundtrack area up to silver metal and generates image dye), stop bath and fixer (arrests development and removes undeveloped silver halide), and bleach (converts exposed, developed silver back to silver halide in both the picture area and soundtrack area) steps. The second development step typically comprises application of a thick, viscous solution of a conventional black and white developer with a cellulose compound such as nitrosyl in a stripe solely onto the soundtrack area of the film, causing the silver halide in the soundtrack area to be selectively developed back into silver metal, while not affecting the silver halide in the image area. A subsequent fixing step then removes the silver halide from the image area, while leaving a silver image corresponding to the soundtrack exposure. Such processing is described for the Kodak ECP-2B Process, e.g., in Kodak Publication No. H-24, Manual For Processing Eastman Color Films. Various other techniques are also known for retaining silver in the soundtrack area, but all such approaches invariably entail certain processing disadvantages, such as critical reactant concentration control and area-selective reactant application requirements. Examples of such techniques, e.g., are set forth in U.S. Pat. Nos. 2,220,178, 2,341,508, 2,763,550, 3,243,295, 3,705,799, and 4,139,382.

It is known that materials that inhibit the bleaching of metallic silver, (so-called bleach inhibitors) are useful for the creation of an auxiliary silver image, for example see U.S. Pat. Nos. 3,715,208 and 3,869,287. These bleach inhibitors are generally materials that strongly coordinate to silver surfaces. It is also known that such bleach inhibitors may be released in an imagewise fashion from a coupler parent (so-called Bleach Inhibitor Releasers or BIRs); for example see U.S. Pat. No. 3,705,801. Bleach inhibitors and BIRs suffer from the disadvantage of interacting with the silver used to generate the colored dye image resulting in inhibition of silver development and color image as well as partially preventing bleaching and silver removal in those areas.

It is known that the silver-based images described above can be generated in a layer separate from the visibly colored image dye layers and that this layer can be sensitized to various wavelengths of light different from the image dye layers, for example, see British Patent 1 504 908 and U.S. Pat. No. 3,737,312.

EP 410726A1 describes the use of S-substituted beta-thioacrylamides as microbiocides.

A problem to be solved is to provide a photographic element that is capable of forming colored dyes and silver images in which the generation of the silver image does not affect the colored dye image and without requiring separate treatments for different regions of the film.

SUMMARY OF THE INVENTION

The invention provides a color photographic element suitable for forming both a colored dye image and a neutral silver-based image, comprising a support bearing at least one light-sensitive silver halide emulsion layer containing a coupler capable of forming a colored dye upon development, and bearing a further light-sensitive silver halide emulsion layer containing a coupler which is capable of releasing a thiovinyl group upon development that is capable of reacting to form a neutral silver-based image.

The invention also provides a novel coupler and imaging method. Embodiments of the invention offer a photographic element that is capable of forming colored dyes and neutral silver-based images in which the generation of the silver image is accomplished without affecting the colored dye image and without requiring separate treatments for different regions of the element.

DETAILED DESCRIPTION OF THE INVENTION

The invention is summarized above. Suitably, the silver image forming coupler is substituted at the coupling site with the sulfur atom of a thiovinyl group or a temporary linking or timing group that, in turn, connects the coupling site with the sulfur of a thiovinyl group. As used herein the term thiovinyl group does not include any compound where the vinyl double bond is part of an aromatic carbocyclic or aromatic heterocyclic ring. Conveniently, the invention provides a photographic element in which the silver image-forming coupler is represented by Formula I:

I

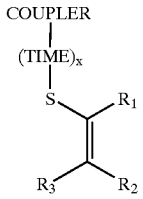

wherein COUPLER represents a species that reacts with oxidized developer, TIME is a linking or timing group, x is 0, 1 or 2 and $R_1$, $R_2$ and $R_3$ are independently selected hydrogen or substituents with the proviso that $R_1$ and $R_2$ may join together provided they are not, together with the intervening double bond, part of a carbocyclic or heterocyclic aromatic ring system.

The invention provides a photographic element that contains a coupler comprising a parent portion (COUPLER), an optional timing group (TIME) and a thiovinyl substituent as a specific kind of coupling-off group. Reaction of the coupler with oxidized developer (Dox) releases the thiovinyl group either directly or after subsequent decomposition of an intermediate in an imagewise fashion. It is believed that decomposition of the released thiovinyl group forms a silver image. Presumably the group decomposes and forms silver sulfide complexes which are not removed from the film by subsequent bleaching or fixing steps.

The coupler is located in a light sensitive silver halide emulsion layer and may be represented by Formula I.

I

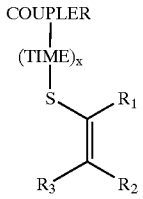

wherein COUPLER represents a species that reacts with oxidized developer, TIME is a linking or timing group, x is 0, 1 or 2 and $R_1$, $R_2$ and $R_3$ are independently selected hydrogen or substituents with the proviso that $R_1$ and $R_2$ together with the intervening double bond are not part of an aromatic ring system.

Upon reaction with Dox, COUPLER may form a colored dye that permanently remains in the film, a colored species that washes out of the film, a colored species that is unstable and decomposes during processing or an uncolored species. COUPLER may also form a dye that absorbs primarily in the infrared region (800–1400 nm) or a polymeric material. Examples of suitable COUPLER moieties are given hereafter but generally include phenols, napthols, pyrazolones, pyrazolotriazoles, hydrazides and open chain acylacetamide compounds. It is preferred that COUPLER forms a cyan, neutral or infrared dye in order to maximize total density at wavelengths of 700 nm or greater.

Preferred couplers that form a yellow dye are according to Formula IIa:

IIa

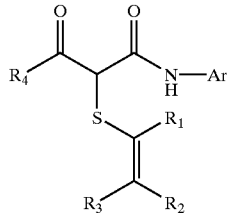

wherein $R_1$, $R_2$ and $R_3$ are as defined above, $R_4$ is an alkyl, aryl or amino group, and Ar represents a substituted aromatic ring.

Preferred couplers that form magenta dyes are according to Formulas IIb–d:

IIb

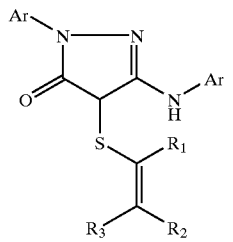

IIc

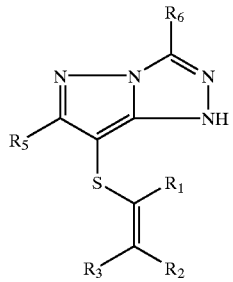

IId

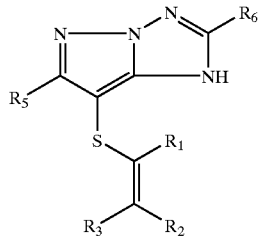

wherein $R_1$, $R_2$ and $R_3$ are as defined above, Ar is as defined for IIa and $R_5$ and $R_6$ are chosen independently from alkyl, aryl, amino, thio and ether groups.

Preferred couplers that form cyan or infrared dyes are according to Formula IIe or IIf:

IIe

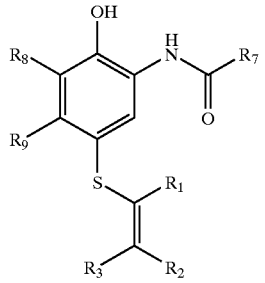

IIf

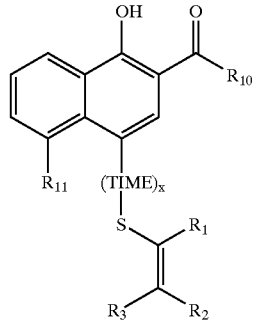

wherein $R_1$, $R_2$ and $R_3$ are as defined above, TIME is a timing group as defined below, x=0, 1 or 2, $R_7$ is an alkyl, aryl or amino group, $R_8$ is hydrogen or a halide group, $R_9$ is an amino or alkyl group, $R_{10}$ is an amino, oxygen, alkyl or aryl group and $R_{11}$ is hydrogen, amino, ether or alkyl group.

TIME is an optional timing or linking group which connects the thiovinyl group to the active site of COUPLER. After reaction with oxidized developer, $-(TIME)_x—S—(R_1C{=}CR_2R_3)$ is released from the coupler and, if x is 1 or 2, this group decomposes to release a free thiovinyl group. This decomposition may be fast (less than 30 seconds) or slow (greater than 30 sec), although it is generally preferred to release free thiovinyl group as fast as possible. Any of the known timing groups or temporary linking groups known in the art are suitable for this invention and particular examples and references as applied to inhibitor releasers are shown hereinafter.

In the thiovinyl coupling-off group of the invention, $R_1$, $R_2$ and $R_3$ are independently chosen from hydrogen or a substituent. For the purpose of the invention, namely the creation of a neutral silver-based image, it is important that the thiovinyl group decomposes during the process, presumably with the formation of free sulfide ions which subsequently form insoluble deposits of silver sulfide. Thus, a compound in which $R_1$ and $R_2$ are joined together in an aromatic ring that forms a stable thiol substituted species during the development process is not part of the invention. By stable during the development process, it is meant that more than 75% of the released fragment remains unchanged after treatment with a developer under the standard conditions of the total development process. In particular, $R_1$ and $R_2$ together cannot be part of a carbocyclic aromatic ring system such as benzene or naphthalene. since such thioaromatic compounds are stable during the process and do not decompose to form the desired silver-based image. Also, $R_1$ and $R_2$ together cannot be part of a heterocyclic aromatic ring such as pyridine since such a compound is stable during the process conditions and does not decompose. In addition, aromatic heterocyclic ring systems formed from $R_1$ and $R_2$ where $R_1$ is a nitrogen atom such as triazoles, etc also are stable during the process and do not decompose. Specifically, groups in which $R_1$ and $R_2$ together with the intervening double bond form substituted or unsubstituted thiophenyl groups (or their annulated analogs) are not part of the invention. Also, specific groups that are excluded from the invention in which $R_1$ is nitrogen and $R_1$ and $R_2$ together with the intervening double bond form an aromatic heterocyclic ring are mercaptotriazoles, mercaptodiazoles, mercaptopyridines, mercaptopyrroles, mercaptofurans, mercaptothiophenes and mercaptopyrimidines. However, there are non-aromatic heterocyclic ring systems in which the thiol substituted heterocycle is not stable and will decompose to release sulfur and which are part of the invention. An example of an unstable heterocyclic coupling-off group would be a sulfur containing hydantoin or succinimide group.

$R_1$, $R_2$ and $R_3$ are independently selected from the group consisting of hydrogen, halogen, nitro, hydroxyl, cyano, carboxyl, carboxy ester, alkyl, alkenyl, alkoxy, aryl, aryloxy, carbamoyl, carbonamido, sulfamoyl, sulfonamido, acyl, sulfonyl, sulfinyl, thio, amino, phosphate, a —O—CO— group, a $—O—SO_2—$ group, a heterocyclic group, a heterocyclic oxy group and a heterocyclic thio group, each of which may be substituted and which contain a 3 to 7 membered heterocyclic ring composed of carbon atoms and at least one hetero atom selected from the group consisting of oxygen, nitrogen and sulfur, or a quaternary ammonium group. Except for the limitations described above, $R_1$, $R_2$ and $R_3$ may be combined in any order to form one or more ring systems. Since some thioamides can be too stable for the purposes of the invention, it is preferred that $R_1$ is not an amino group. It is preferred that among $R_1$, $R_2$ and $R_3$, there is at least one water solubilizing group chosen from, among carboxylic acid, sulfonic acid, hydroxy, phosphate, carbamoyl or sulfonamide groups. It is preferred that none of $R_1$, $R_2$ or $R_3$ is a ballast group that limits diffusion or decreases water solubility. It is also preferred that the entire thiovinyl coupling-off group contains no more than 10 carbon atoms in total. It is further preferred that $R_2$ is hydrogen and more preferred that both $R_1$ and $R_2$ are hydrogen.

When $R_1$, $R_2$ and $R_3$ do not form a cyclic system, it is possible to form isomeric species. For example, if $R_1$ and either $R_2$ or $R_3$ were hydrogen, then either a cis or trans substituted ethylene group is formed. For the purposes of this invention, all possible isomeric forms should be considered equivalent irregardless of the structure shown.

One embodiment of the invention comprises a method for recording and processing image area frames and an optical soundtrack on different areas of a color motion picture film comprising a support bearing blue, green, and red light sensitive silver halide emulsion dye forming layers and at least one auxiliary silver image forming layer, comprising imagewise exposing said emulsion layers in accordance with desired color image area frames, exposing the auxiliary silver image forming layer in accordance with an analog soundtrack, and processing the entire area of the exposed film in a single process to simultaneously yield corresponding dye images in the exposed image area frames and analog soundtrack; wherein the auxiliary silver image forming layer comprises a light-sensitive silver halide emulsion containing the coupler of the invention, and wherein said film is processed to yield a dye image and a silver analog soundtrack. The soundtrack region of the film not subjected to any specialized processing treatment relative to the image area frame region.

The preferred photographic elements of this invention comprise a transparent support having coated thereon (1) an image or picture recording photographic unit comprising at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler and (2) an auxiliary silver image forming layer which contains a light sensitive silver halide emulsion and silver-forming coupler of the invention.

The light sensitive silver halide emulsion layer contained along with the silver-forming coupler in the auxiliary silver image forming layer above may be sensitive to any wavelength of light. However, it is preferred that the latent images needed to generate the color image are not formed in the silver image forming auxiliary layer. It is preferred to achieve exposure of the color imaging layers without significant exposure of the auxiliary silver imaging layer. This can be accomplished by any of the well known methods for selectively exposing one or more layers in the presence of another; for example, as discussed for film elements with both color and auxiliary silver imaging layers in U.S. Pat. No. 3,705,801, column 7, line 38 to column 8, line 23 and whose contents are incorporated herein by reference. The auxiliary layer may be independently exposed before, after or simultaneously with the other color forming layers.

In particular, the light sensitive silver halide emulsion of the auxiliary silver image forming layer may be sensitive to predominately IR (>700 nm) or UV (<400 nm) light. It may be sensitive to red, green or blue light so long as its effective sensitivity in its own layer is substantially less than the emulsions used to generate the dye image. This may be accomplished, for example, by making the silver image forming emulsion significantly smaller in size than the dye image forming emulsions or by making it of substantially different morphology. It is also possible to decrease the overall sensitivity of the silver image forming layer by locating an appropriate filter layer between the light source and the layer. For example, a magenta colored filter layer could be located under (further from the light source) a green sensitive dye forming layer but above (closer to the light source) the silver image forming layer containing a green sensitive emulsion; the same is possible for a yellow filter layer and blue sensitive emulsion or a cyan filter layer and a red sensitive emulsion. It is also possible to locate an appropriate filter layer between the silver image layer and the dye image layers and expose the silver image layer through the support.

It should be noted that exposure and subsequent image dye formation in the color image forming layers may occur simultaneously with exposure and subsequent formation of silver image in the auxiliary layer so that a color image is formed in register with the silver image. For example, exposure of a green light sensitive silver image forming emulsion in the auxiliary layer may also expose the green light sensitive and magenta dye forming layer as well so both a magenta dye image and silver image are formed each in their own layers. If a blue or red sensitive emulsion in the auxiliary layer is used, a yellow or cyan dye image may also be formed in the blue or red light sensitive color image forming layers. It is possible that any combination of yellow, magenta or cyan dyes are formed either separately or together during the formation of the silver image in the auxiliary layer.

The light sensitive silver halide emulsion of the auxiliary silver image forming layer may be of any size, halide content or morphology necessary to achieve the object of the invention. For example, the size of the emulsion can range from at least 0.01, or more preferably at least 0.05 to 10 or more preferably, less than 7 microns in diameter. The emulsion may contain any combination of chloride, bromide and iodide. The emulsion may be tabular, cubic or octahedral in shape. The silver content of the auxiliary layer can vary widely, depending on the need to produce adequate density in the silver image. For example, the total amount of silver as silver halide in the auxiliary layer may typically range from 0.054 to 2.16 g/m$^2$. It is preferred that the amount of silver be in the range of 0.108 to 1.08 g/m$^2$ and especially 0.162 to 0.810 g/m$^2$.

The auxiliary silver image-forming layer may be located anywhere in the film element relative to the color image forming layers. This layer may optionally contain permanent dye forming couplers along with a coupler of Formula I in order to augment the silver image. These additional couplers may form dyes that absorb light in the visible region (400–700 nm), the UV region (<400 nm), the IR region (700–1000 nm), or broadly across one or more of these regions. This layer may also optionally contain an interlayer scavenger to react with oxidized developer without dye formation.

To control the migration of the silver forming couplers, it is desirable that COUPLER includes a high molecular weight hydrophobic or "ballast" group. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 6 to 42 carbon atoms. Such substituents can also be further substituted.

The laydown of the silver forming couplers is important to obtain the desired effect. In general, the molar ratio of coupler to silver should be at least 0.002 and more preferably, at least 0.04 and most preferably, at least 0.12.

Suitable examples of the silver-forming couplers useful in this invention are as follows:

A-1

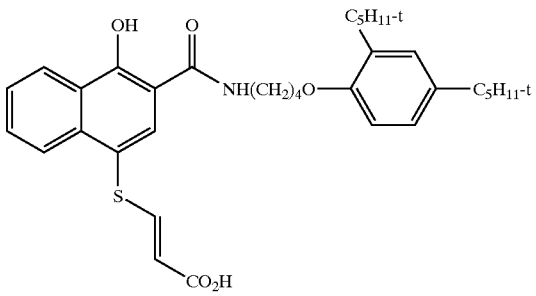

A-2

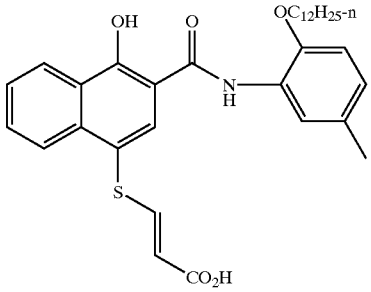

-continued
A-3
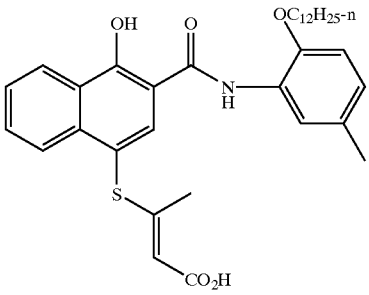
A-4
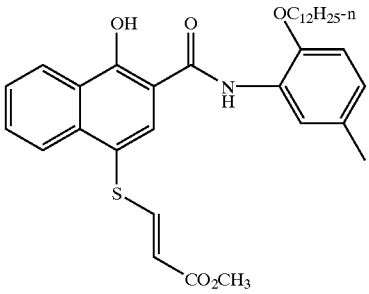
A-5
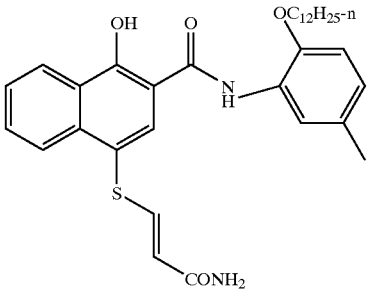
A-6
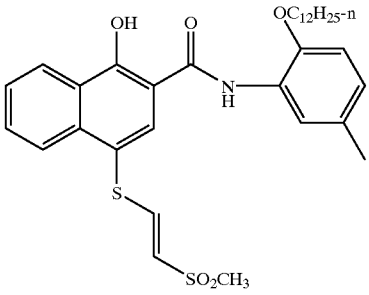
A-7
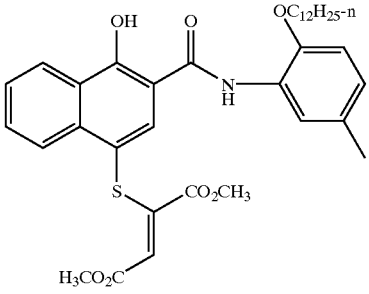
-continued
A-8
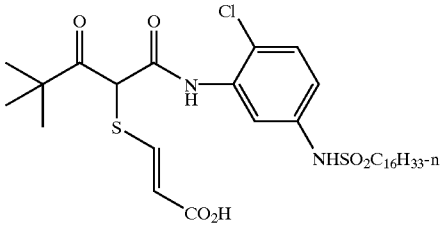
A-9
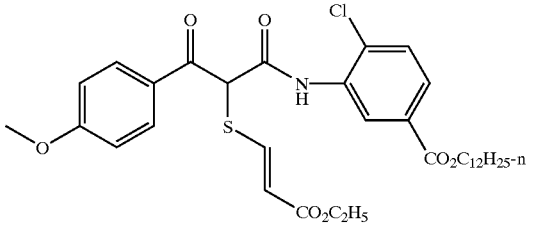
A-10
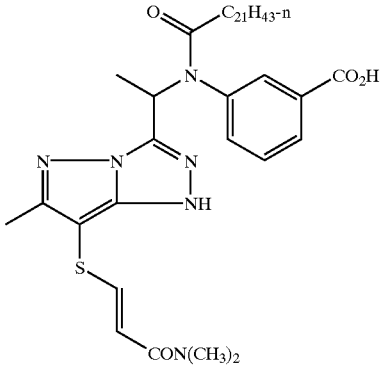
A-11
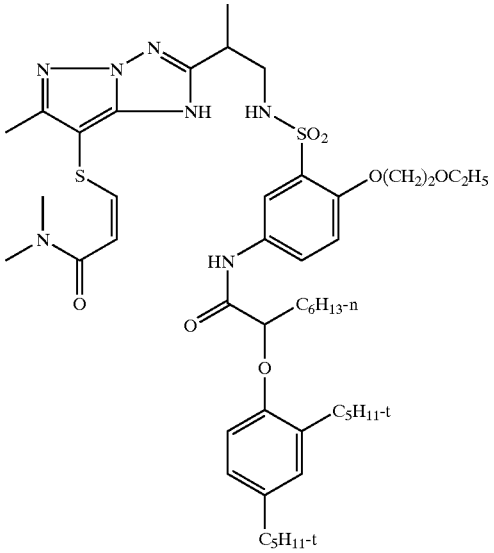

-continued
A-12
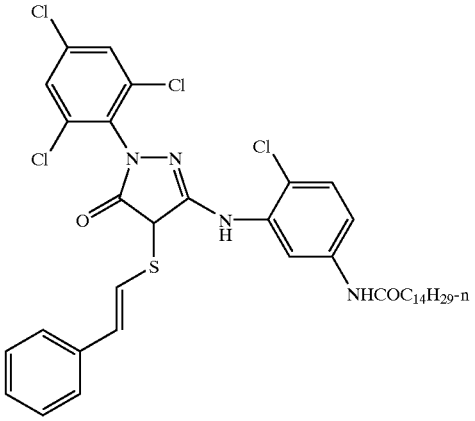
A-13
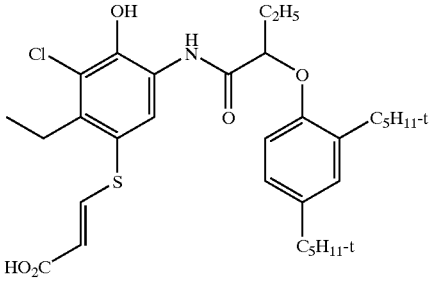
A-14
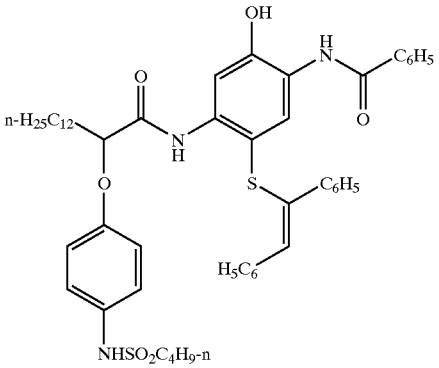
A-15
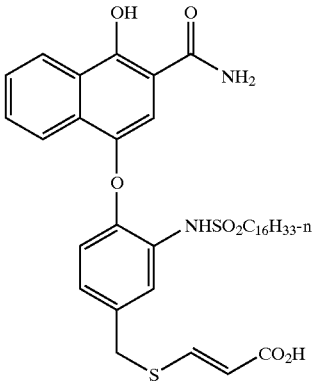
-continued
A-16
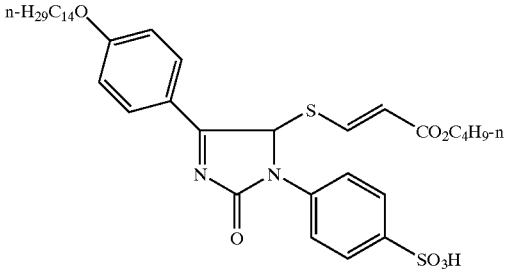
A-17
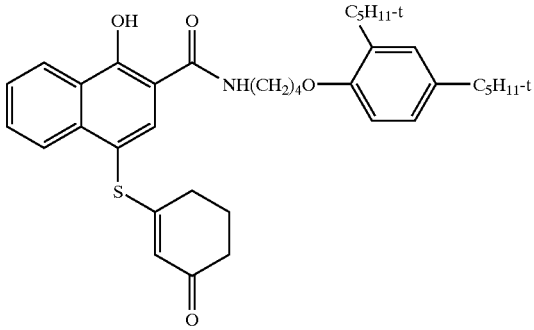
A-18
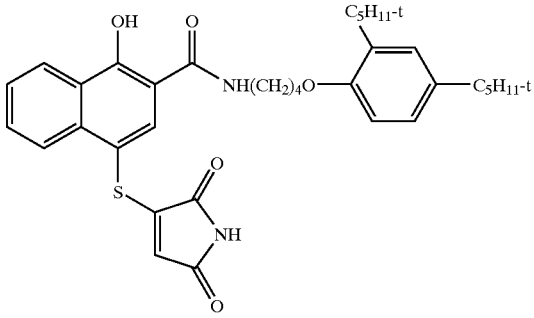
A-19
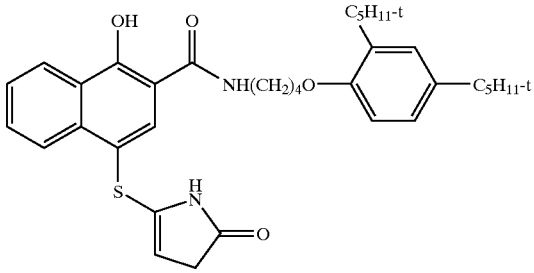
A-20
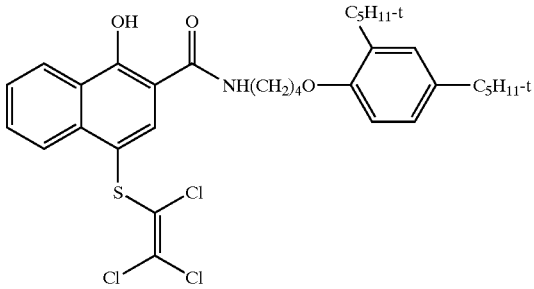

The materials of the invention can be added to a solution containing silver halide before coating or be mixed with the silver halide just prior to or during coating. In either case, additional components like couplers, doctors, surfactants, hardeners and other materials that are typically present in such solutions may also be present at the same time. The materials of the invention are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent that is stabilized by suitable surfactants and surface active agents usually in combination with a binder or matrix such as gelatin. The dispersion may contain one or more permanent coupler solvent that dissolves the material and maintains it in a liquid state. Some examples of suitable permanent coupler solvents are tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, trioctylamine and 2-ethylhexylphosphate. The dispersion may require an auxiliary coupler solvent to initially dissolve the component but is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials of the invention may also be dispersed as an admixture with another component of the system such as a coupler or an oxidized developer scavenger so that both are present in the same oil droplet.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino,p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfmyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-4 6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure. In particular, the COUPLER according to Formula I may be chosen from any of the suitable coupling species described below.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531,; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO0

539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.). Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946, 767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

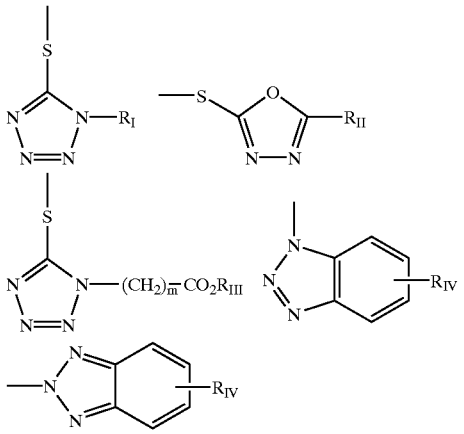

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

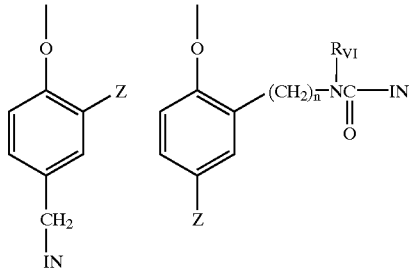

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

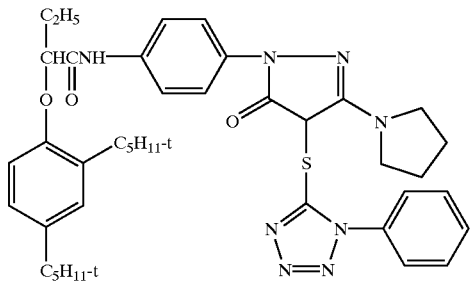

-continued
D2
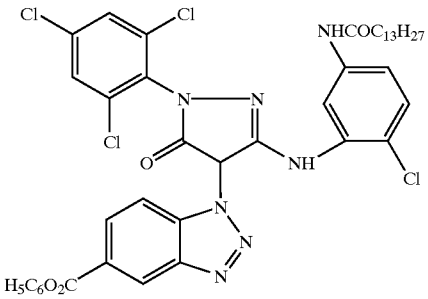
D3
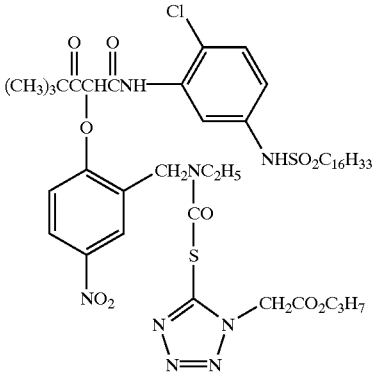
D4
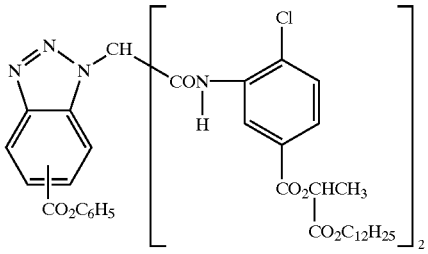
D5
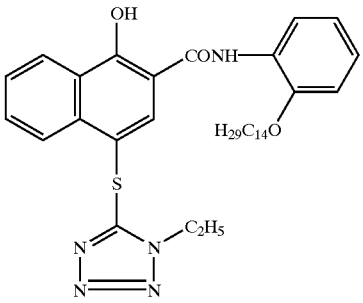
D5
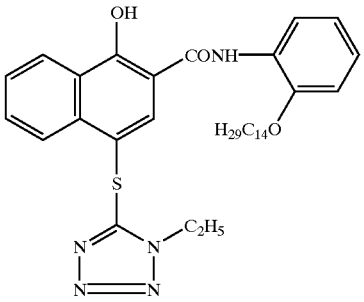
-continued
D6
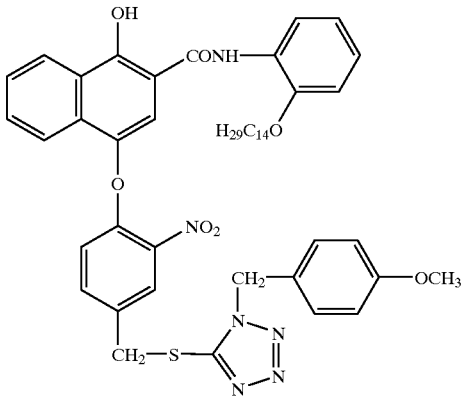
D7
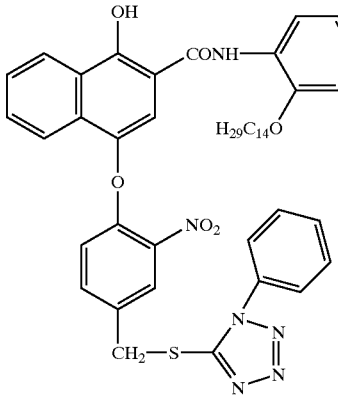
D9
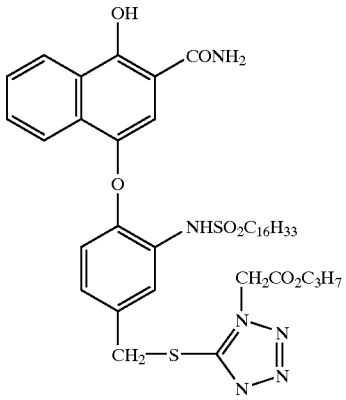
D8
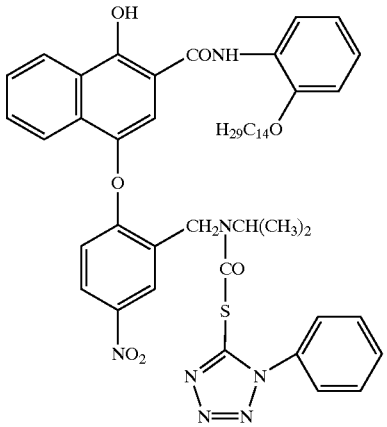

-continued

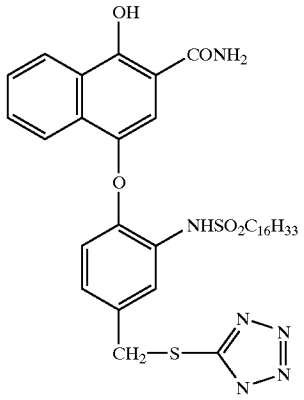

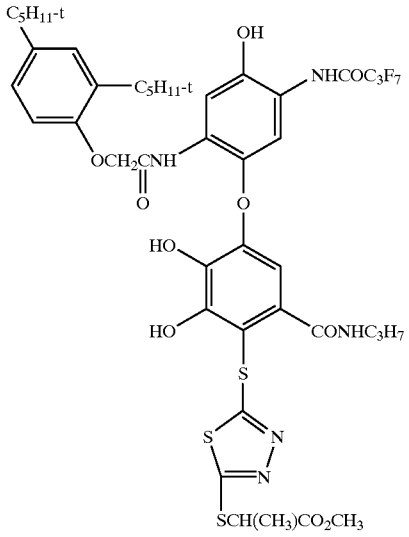

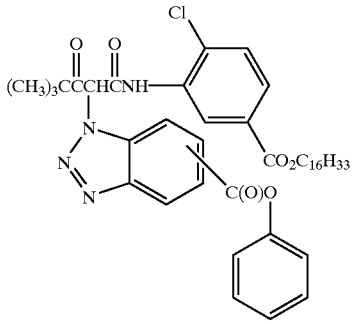

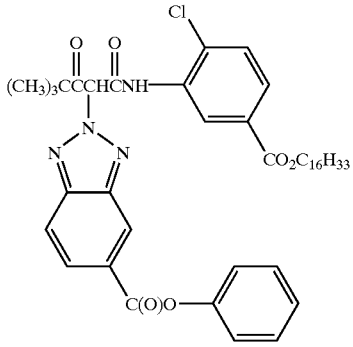

D9 Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

D10 The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

D11 As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

D12 Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process. It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention. It is further specifically contemplated that the print elements of the invention may comprise antihalation and antistatic layers and associated compositions as set forth in U.S. Pat. Nos. 5,650,265, 5,679,505, and 5,723,272, the disclosures of which are incorporated by reference herein.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 1.0 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubooctahedral (i.e., tetradecahedral) grains, or the grains can take other shapes attributable to ripening, twinning, screw dislocations, etc. Typically, print element emulsions grains are bounded primarily by {100} crystal faces, since {100} silver chloride grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

In one embodiment of the invention, after motion picture print films are exposed, they are processed in accordance with this invention to form a visible color image in the image area frame region of the film and an auxiliary silver analog soundtrack. Processing a silver halide color photographic light-sensitive material is basically composed of two steps of 1) color development and 2) desilvering of the silver used to generate the color image while the auxiliary sound track silver image is retained. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals may be liquids, pastes, or solids, such as powders, tablets or granules. One standard process is the Kodak ECP-2B Color Print Development Process as described in the Kodak H-24 Manual, "*Manual for Processing Eastman Motion Picture Films*", Eastman Kodak Company, Rochester, N.Y., the disclosure of which is incorporated by reference herein, The following processing steps may be included in the preferable processing steps (processes 1–5 may also include a stop bath after development) carried out in accordance with the invention:

1) Color developing→bleach-fixing→washing/stabilizing;

2) Color developing→bleaching→fixing→washing/stabilizing;

3) Color developing→bleaching→bleach-fixing→washing/stabilizing;

4) Color developing→bleach-fixing→fixing→washing/stabilizing;

5) Color developing→bleaching→bleach-fixing→fixing→washing/stabilizing.

6) Color developing→stopping→washing→bleaching→washing→fixing→washing/stabilizing;

In one embodiment of the invention, there are several currently practiced conventional process steps that are used especially for processing motion picture films. Accordingly, this embodiment of the invention allows for a prebath rem-jet removal station, a the rem-jet spray rinse and if necessary the soundtrack spray rinse. In this embodiment of the invention, the simplified process for motion picture films of the invention consists essentially of: developer, stop, wash, bleach, bleach wash, fix, wash, fmal rinse, and dry steps. In a further embodiment of the invention, the process consists essentially of developer, blix, wash, and dry steps. It is preferred than a stop be used being the developer and blix steps.

The entire contents of the patent applications, patents and other publications referred to in this specification are incorporated herein by reference.

Synthesis

Experimental details are described for the synthesis of compound A-1 according to the scheme below. The same procedures can be applied to the synthesis of other compounds of this invention.

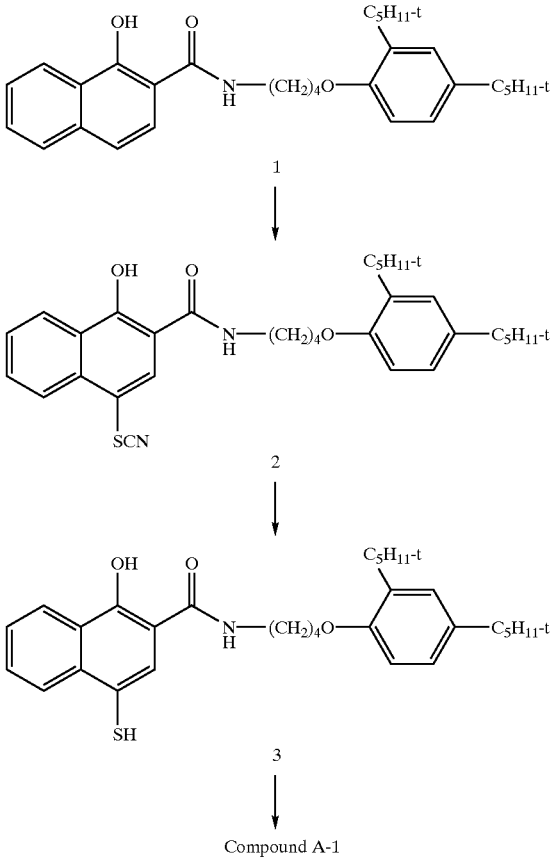

4.6 ml (0.084 mol) $Br_2$ was added dropwise to a stirred solution of 12.8 g (0.168 mol) $NH_4SCN$ in 400 ml acetic acid at room temperature. The solution turned yellow and a solid formed. After 10 minutes 40 g (0.084 mol) coupler 1 was added. A thick solid formed and was broken up mechanically and stirred for an additional 50 minutes. The solids were filtered off and washed with acetic acid and then water. The filter cake was partially dried on the funnel then used as is. The wet filter cake was dissolved in 1.0 liter acetic acid containing 40 ml concentrated HCl at 70° C. 200 g powdered Zn was added portion-wise to the stirred solution at such a rate to control the foaming. After stirring at 70° C. for 45 minutes the solids were filtered from the hot solution, added to 2 liters water and the pale yellow solid collected, washed with water, and dried overnight on the funnel to yield 24 g compound 3. 3.8 g (0.070 mol) sodium methoxide was added to 10 g (0.020 mol) 3 and 1.4 g (0.070 mol) propiolic acid in 300 ml methanol stirred at RT and then brought to reflux for 3 hours. After cooling, dilute HCl and ether were added and the organic layer separated, washed with water, dried with $MgSO_4$, evaporated, and chromatographed on $SiO_2$ with $CH_2Cl_2/Et_2O$ to give 4.2 g final coupler A-1. Analysis: found C 71.0, H 7.4, N 2.3; theoretical C 70.7, H 7.5, N 2.4. NMR consistent with structure.

Photographic Examples

The invention is illustrated by incorporating the couplers of the present invention along with the appropriate control couplers into test single-layer photographic coatings according to the following diagram. All laydowns are in g/m$^2$.

| | |
|---|---|
| Overcoat | 5.38 Gelatin<br>0.19 Bis-vinylsulfonylmethylether |
| Emulsion Layer: | 3.23 Gelatin<br>1.08 green sensitized AgIBr tabular emulsion<br>$1.0 \times 10^{-5}$ 4-hydroxy-6-methyl-1,3,3a,7-tetraazaindene<br>$1.08 \times 10^{-3}$ moles/m$^2$ of coupler (dispersed in twice its own weight of N,N-diethyllauramide) |
| Support | Cellulose Acetate subbed with 2.42 Gelatin with RemJet backing |

The structure of the comparison material CA-1 is:

CA-1

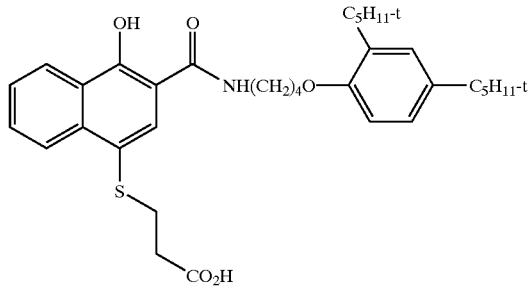

These coatings were given a stepped exposure and processed through a standard C41 process as described in *British Journal of Photography Annual* (1988), pp 196–198 using the following steps and process times:

| | |
|---|---|
| Developer | 3.25 minutes |
| Stop Bath (1% $H_2SO_4$) | 1.0 minutes |
| Bleach (diluted 50% with water) | 4.0 minutes |
| Wash | 2.0 minutes |
| Fix | 4.0 minutes |
| Wash | 2.0 minutes |

Blue, green and red density along with the amount of retained silver (in g/m$^2$ as determined by X-ray fluorescence) were measured at Dmin and Dmax. The results are shown in Table 1.

TABLE 1

Photographic Analysis

| Sample No | Comp/Inv | Coupler | | Dmin | Dmax |
|---|---|---|---|---|---|
| 1 | Comp | CA-1 | Blue | 0.046 | 0.090 |
| | | | Green | 0.082 | 0.194 |
| | | | Red | 0.089 | 1.578 |
| | | | Silver | 0 | <0.01 |
| 2 | Inv | A-1 | Blue | 0.045 | 0.300 |
| | | | Green | 0.085 | 0.361 |
| | | | Red | 0.131 | 1.769 |
| | | | Silver | 0 | 0.07 |

In Table 1, CA-1 is identical to A-1 except lacking the double bond in the coupling-off group. When 3-mercaptopropionic acid is released from CA-1, it is stable and does not leave a silver scale after processing. The inventive coupler A-1 releases 2-mercaptoacrylic acid which forms a neutral silver-based image after processing thereby increasing the R, G and B density.

Multilayer films demonstrating the principles of this invention were produced by coating the following layers on a transparent polyethylene terephthalate support with polyurethane overcoated vanadium pentoxide anti-static layer on the back of the film base which provides process surviving anti-static properties (coverages are in mg/m$^2$). Each element also contained bisvinylsulfonylmethane (BVSM) as a gelatin hardener. Couplers were dispersed with high-boiling coupler solvents and/or auxiliary solvents in accordance with conventional practice in the art. In addition, surfactants, spreading agents, coating aids, emulsion addenda, sequestrants, thickeners, lubricants, matte and tinting dyes were added to the appropriate layers as common in the art.

EXAMPLE ML-1

| | |
|---|---|
| Layer 1 (Protective Overcoat): | |
| Gelatin | 976 |
| Polydimethylsiloxane lubricant | 16 |
| Polymethylmethacrylate beads | 16 |
| Layer 2 (Green Emulsion Layer): | |
| AgClBr cubic grain emmision, 1.35% Br, 0.14 micron, spectrally sensitized with green sensitizing dye GSD-1, 0.363 mmole/Ag mole, and green sensitizing dye GSD-2, 0.012 mmole/Ag mole. | 73.5 |
| AgClBr cubic grain emulsion, 1.2% Br, 0.18 micron, spectrally sensitized with green sensitizing dye GSD-1, 0.293 mmole/Ag mole, and green sensitizing dye GSD-2, 0.009 mmole/Ag mole. | 343 |
| AgClBr cubic grain emulsion, 1.7% Br, 0.26 micron, spectrally sensitized with green sensitizing dye GSD-1, 0.273 mmole/Ag mole, and green sensitizing dye GSD-2, 0.008 mmole/Ag mole. | 73.5 |
| Magenta Dye Forming Coupler M-1 | 689 |
| Green Filter Dye GFD-1 | 27 |
| Green Filter Dye GFD-2 | 27 |
| Tricresyl phosphate | 140 |
| Oxidized Developer Scavenger Scav-1 | 11 |
| Gelatin | 1506 |
| Layer 3 (Interlayer): | |
| Oxidized Developer Scavenger Scav-1 | 86 |
| Gelatin | 610 |
| Layer 4 (Red Emulsion Layer): | |
| AgClBr cubic grain emulsion, 0.8% Br, 0.14 micron, spectrally sensitized with red sensitizing dye RSD-1, 0.042 mmole/Ag mole. | 117.5 |
| AgClBr cubic grain emulsion, 0.9% Br, 0.18 micron, spectrally sensitized with red sensitizing dye RSD-1, 0.044 mmole/Ag mole.. | 218.5 |
| AgClBr cubic grain emulsion, 0.9% Br, 0.26 micron, spectrally sensitized with red sensitizing dye RSD-1, 0.050 mmole/Ag mole. | 70 |
| Cyan dye forming coupler C-1 | 850 |
| Red Absorber Dye Pina TM Filter Blue Green (Riedel-de Haen Company) | 68 |
| Gelatin | 3120 |
| Layer 5 (Interlayer) | |
| Oxidized Developer Scavenger Scav-1 | 86 |
| Gelatin | 610 |
| Layer 6 (Blue Emulsion Layer): | |
| AgClBr cubic grain emulsion, 0.4% Br, 0.40 micron, spectrally sensitized with blue sensitizing dye BSD-1, 0.151 mmole/Ag mole and blue sensitizing dye BSD-2, 0.149 mmole/Ag mole. | 259 |
| AgClBr cubic grain emulsion, 0.5% Br, 0.50 micron, spectrally sensitized with blue sensitizing dye BSD-1, 0.219 mmole/Ag mole and blue sensitizing dye BSD-2, 0.217 mmole/Ag mole. | 370 |
| AgClBr cubic grain emulsion, 0.3% Br, 0.90 micron, spectrally sensitized with blue sensitizing dye BSD-1, 0.124 mmole/Ag mole and blue sensitizing dye BSD-2, 0.122 mmole/Ag mole. | 167 |
| Yellow Coupler (Y-1) | 1291 |
| Blue filter dye BFD-1 | 31 |
| Metal Ion Sequestrant Seq-1 | 43 |
| Metal Ion Sequestrant Seq-2 | 22 |
| UV dye UV-1 | 215 |
| Yellow Preformed Dye YPD-1 | 11 |
| Gelatin | 2474 |

-continued

| | |
|---|---|
| Layer 7 (Antihalation Layer): | |
| Antihalation Filter Dye AFD-1 | 113 |
| Antihalation Filter Dye AFD-2 | 269 |
| Polymer-1 | 25 |
| Gelatin | 759 |
| Layer 8 (Silver Sound Track Recording Layer): | |
| Polymer-1 | 12.4 |
| Gelatin | 1076 |

EXAMPLE ML-2

Example ML-2 was prepared as ML-1 except that 323 of a 0.14 micron AgClBr cubic grain emulsion (same as used in Layer 4) and 492 of CA-1 was added to Layer 8.

EXAMPLE ML-3

Example ML-3 was prepared as ML-2 except that CA-1 in layer 8 was replaced with A-1 at 490.

The following structures represent compounds utilized in the above multilayer photographic elements.

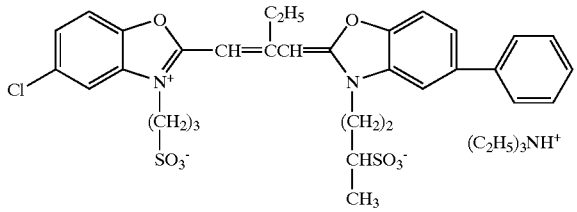

Green sensitizing dye GSD-1

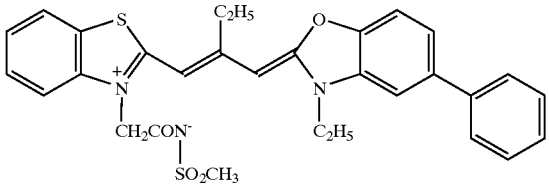

Green sensitizing dye GSD-2

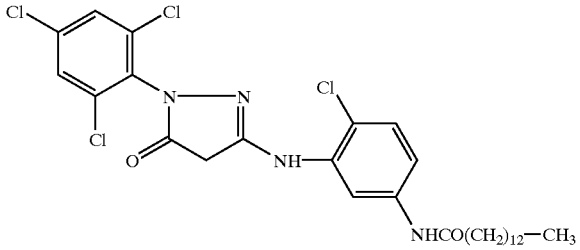

magneta coupler M-1

-continued
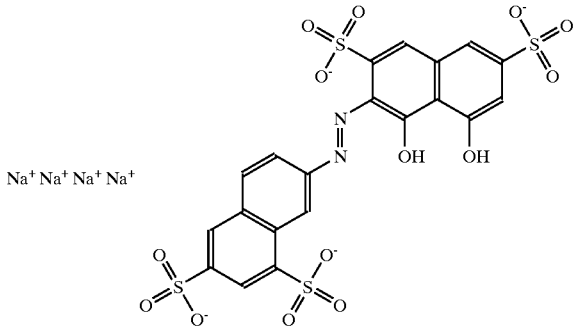
Green Filter Dye GFD-1
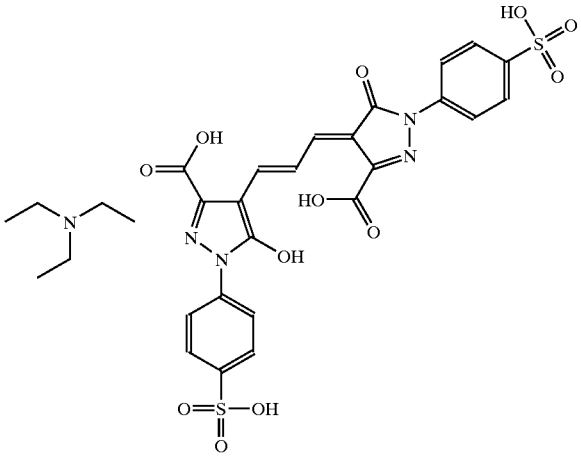
Green Filter Dye GFD-2
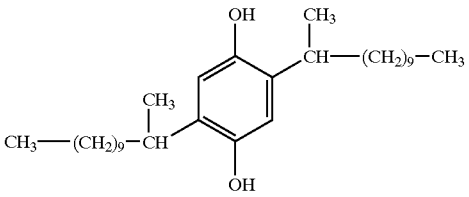
scavenger Scav-1
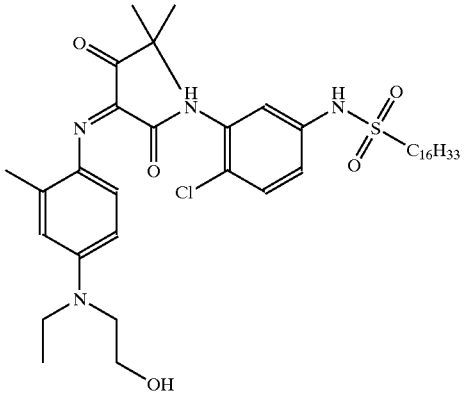
Yellow Preformed Dye YPD-1
-continued
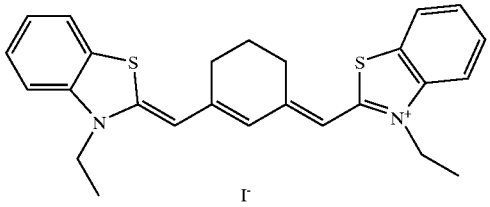
Red sensitizing dye RSD-1
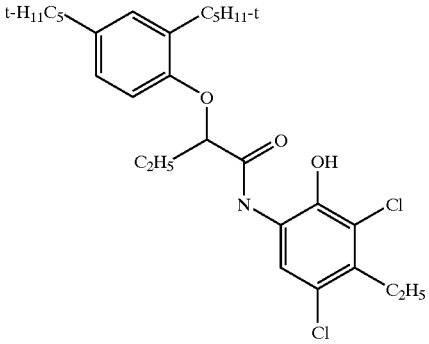
cyan coupler C-1
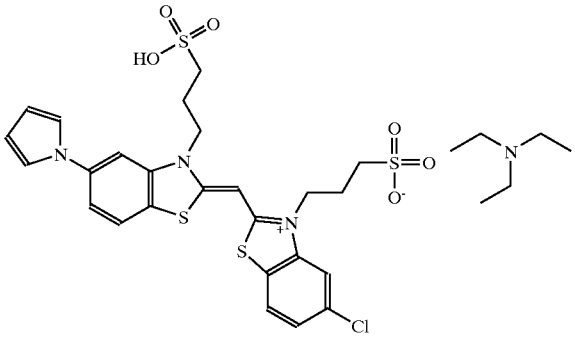
Blue sensitizing dye BSD-1
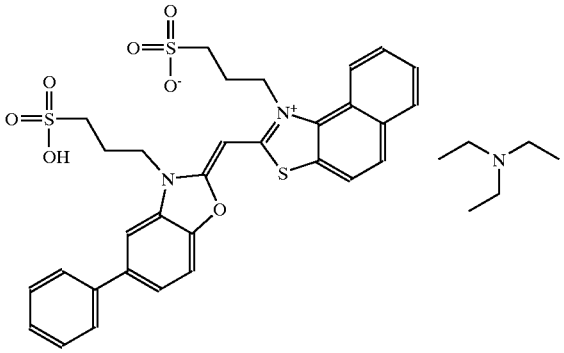
Blue sensitizing dye BSD-2
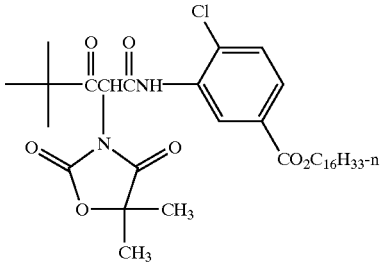
yellow coupler Y-1

-continued

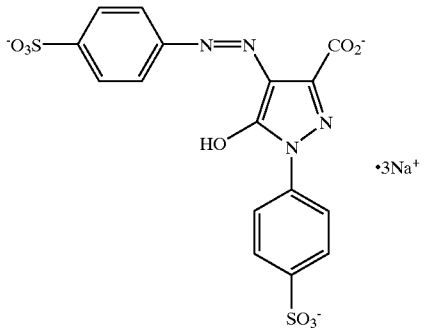

Blue filter dye BFD-1

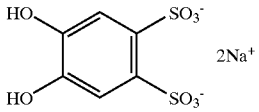

Sequestrant Seq-1

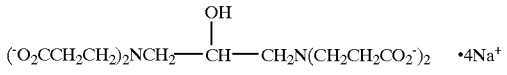

Sequestrant Seq-2

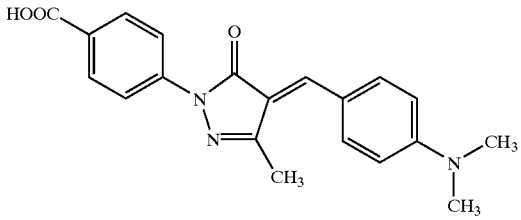

Antihalation filter dye AFD-1

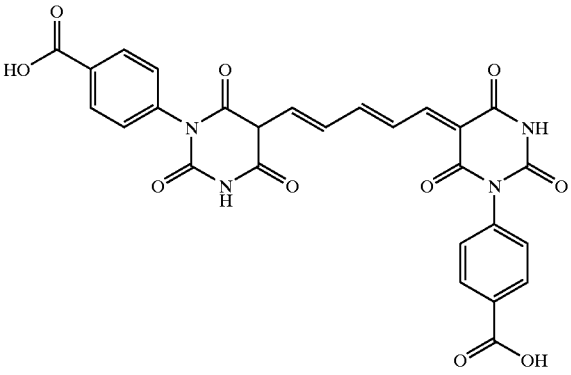

Antihalation filter dye AFD-2

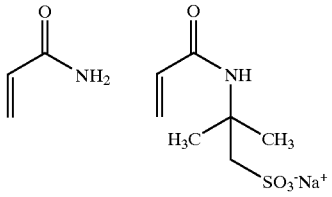

20/80 Copolymer by Weight

Polymer-1

-continued

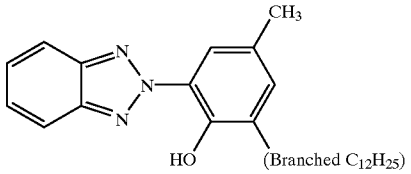

UV Dye UV-1

These multilayer coatings were given the same stepped exposure with red light either from the front side of the element (support farthest from the light source) or from the back-side (support closest to the light source). Each type of exposure was given to one half of the same coating. The exposed coatings were processed at 36.6° C. according to a modified Kodak ECP-2B Color Print Development using the following processing solutions and times. The ECP-2B Color Developer (3 minutes) consists of:

| | |
|---|---|
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/− 0.05 | |

The ECP-2B Stop Bath (1 minute) consists of:

| | |
|---|---|
| Water | 900 mL |
| Sulfuric acid (7.0N) | 50 mL |
| Water to make 1 liter | |
| pH @ 26.7° C. is 0.90 | |

The Bleach (4 minutes) consists of:

| | |
|---|---|
| Water | 600 mL |
| Ammonium Bromide | 25 g |
| 1,3-Propanediaminetetraacetic acid (PDTA) | 15.14 g |
| Ammonium hydroxide (28% ammonia) | 17.6 g |
| Ferric nitrate nonahydrate | 18.2 g |
| Glacial acetic acid | 13.25 g |
| 1,3-Diamino-2-propanoltetraacetic acid (Rexpronol Acid, Grace) | 0.5 g |
| Ammonium ferric EDTA (1.56M, pH 7.05, 44% wt.) (contains 10% molar excess EDTA, 3.5% wt.) | 74.5 |
| Water to make 1 liter | |

Water Rinse for 2 minutes

The Fix (4 minutes) consists of:

| | |
|---|---|
| Water | 500 mL |
| Ammonium Thiosulfate (58% solution) | 214 g |
| (Ethylenedinitrilo)tetraacetic acid, disodium salt, dihydrate | 1.29 g |
| Sodium metabisulfite | 11.0 g |

-continued

| | |
|---|---|
| Sodium Hydroxide (50% solution) | 4.7 g |
| Water to make 1 liter | |

Water rinse for 2 minutes

The processed coatings, each containing a top and bottom exposure on the same strip, were then measured for density (IR at 1000 nm) and for retained silver (by X-Ray fluorescence). The results are shown in Table 2.

TABLE 2

Photographic Analysis of Multilayer Coatings

| Sample No | Comp/Inv | Layer 8 | Color | Dmin | Dmax |
|---|---|---|---|---|---|
| | | Exposure from Front | | | |
| ML-1 | Comp | Gel Only | Blue | 0.121 | 0.353 |
| | | | Green | 0.058 | 0.622 |
| | | | Red | 0.080 | 3.975 |
| | | | Silver | 0 | <0.02 |
| | | | IR density | 0.04 | 0.05 |
| ML-2 | Comp | CA-1 | Blue | 0.116 | 0.357 |
| | | | Green | 0.057 | 0.633 |
| | | | Red | 0.119 | 4.335 |
| | | | Silver | 0 | <0.02 |
| | | | IR Density | 0.04 | 0.05 |
| ML-3 | Inv | A-1 | Blue | 0.180 | 0.390 |
| | | | Green | 0.069 | 0.618 |
| | | | Red | 0.180 | 3.957 |
| | | | Silver | 0 | <0.02 |
| | | | IR Density | 0.04 | 0.05 |
| | | Exposure from Back | | | |
| ML-1 | Comp | Gel Only | Blue | 0.114 | 0.116 |
| | | | Green | 0.053 | 0.056 |
| | | | Red | 0.058 | 0.250 |
| | | | Silver | 0 | <0.02 |
| | | | IR Density | 0.04 | 0.04 |
| ML-2 | Comp | CA-1 | Blue | 0.119 | 0.299 |
| | | | Green | 0.066 | 0.201 |
| | | | Red | 0.125 | 1.488 |
| | | | Silver | 0 | <0.02 |
| | | | IR Density | 0.04 | 0.05 |
| ML-3 | Inv | A-1 | Blue | 0.168 | 0.531 |
| | | | Green | 0.074 | 0.380 |
| | | | Red | 0.202 | 1.742 |
| | | | Silver | 0 | 0.05 |
| | | | IR Density | 0.04 | 0.13 |

The multilayer results in Table 2 show that only the color image forming layers are developed when exposed from the front of the film. However, only Layer 8 is substantially developed when exposed from the back of the film as demonstrated by the small amounts of red density formed in ML-1 with this type of exposure. When Layer 8 contains the inventive coupler, a silver image is formed as seen in both the visual regions (developed silver is neutral in color) and by direct measurement. The comparison coupler CA-1 does not form the desired silver image. This demonstrates that with the couplers of the invention, it is possible to create a separate silver image and a color image in the same film using a single process that is applied uniformly to the entire film.

The invention has been described in detail with particular reference to preferred embodiments thereof, but it will be understood that variations and modifications can be effected within the scope and spirit of the invention.

What is claimed is:

1. A color photographic element suitable for forming both a colored dye image and a neutral silver-based image, comprising a support bearing at least one light-sensitive silver halide emulsion layer containing a coupler capable of forming a colored dye upon development, and bearing a further light-sensitive silver halide emulsion layer containing a coupler which is capable of releasing a thiovinyl group upon development that is capable of reacting to form a neutral silver-based image.

2. The color photographic element of claim 1 wherein the neutral silver-based image represents audio information.

3. The element of claim 2 wherein the element, when viewed in the direction of exposure, comprises a frame area for forming a color image of the subject and an area outside the frame area for forming the neutral silver-based image.

4. The photographic element of claim 1 wherein the neutral silver-based image forming coupler is represented by Formula I:

I

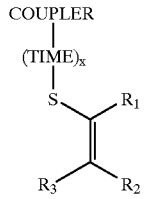

wherein:

COUPLER represents a species that reacts with oxidized developer,

TIME is a linking or timing group, x is 0, 1 or 2 and $R_1$, $R_2$ and $R_3$ are independently selected hydrogen or substituents with the proviso that $R_1$ and $R_2$ may be joined provided that they do not, together with the intervening double bond, form part of an aromatic ring system.

5. A color photographic element of claim 4 wherein the neutral silver-based image represents audio information.

6. The photographic element of claim 4 wherein COUPLER in the coupler of Formula I is capable of forming a cyan, neutral or infrared dye.

7. The photographic element of claim 5 wherein COUPLER in the coupler of Formula I is capable of forming a cyan, neutral or infrared dye.

8. The photographic element of claim 4 in which $R_1$, $R_2$ and $R_3$ are chosen independently from the group consisting of hydrogen, halogen, nitro, hydroxyl, cyano, carboxyl, carboxy ester, alkyl, alkenyl, alkoxy, aryl, aryloxy, carbamoyl, carbonamido, sulfamoyl, sulfonamido, acyl, sulfonyl, sulfinyl, thio, amino, phosphate, oxycarbonyl, oxysulfonyl, heterocyclic, heterocyclic oxy, and heterocyclic thio groups, the heterocycles of which may be substituted and which contain a 3 to 7 membered heterocyclic ring composed of carbon atoms and at least one hetero atom selected from the group consisting of oxygen, nitrogen and sulfur, or a quaternary ammonium group.

9. The photographic element of claim 8 wherein x in the coupler of Formula I is 0.

10. The photographic element of claim 9 wherein $R_1$ in the coupler of Formula I is hydrogen.

11. The photographic element of claim 10 wherein $R_2$ in the coupler of Formula I is hydrogen.

12. The element of claim 11 wherein $R_3$ in the coupler of Formula I is a water solubilizing group.

13. The photographic element of claim 4 in which the neutral silver-based image forming coupler is selected from the following:

A-1:
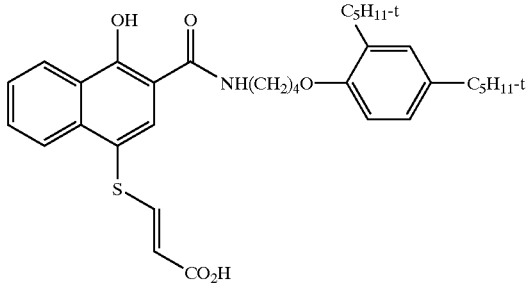
A-2:
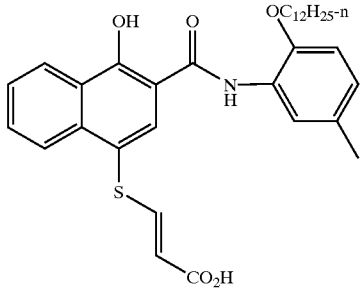
A-4:
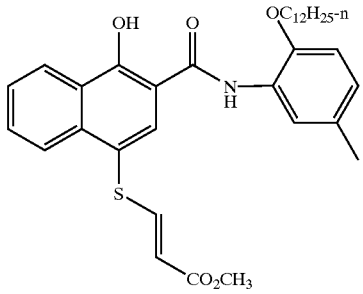
A-5:
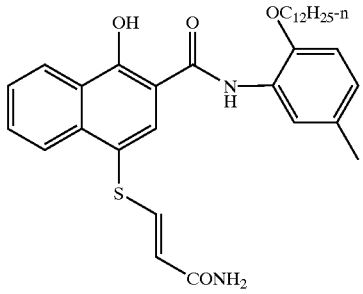
A-13:
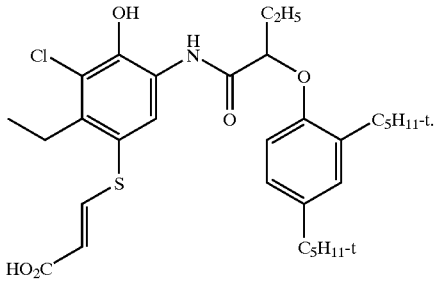
14. The photographic element of claim 5 in which the neutral silver-based image forming coupler is selected from the following:
A-1:
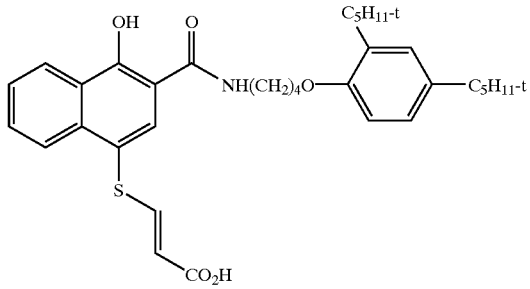
A-2:
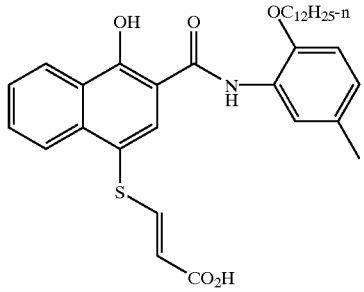
A-4:
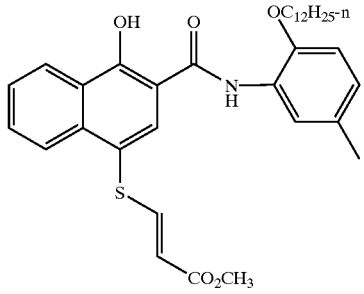
A-5:
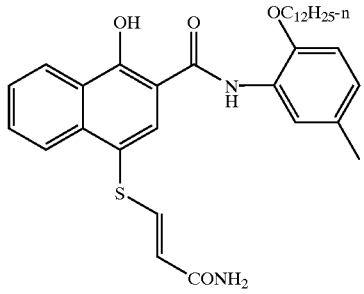
A-13:
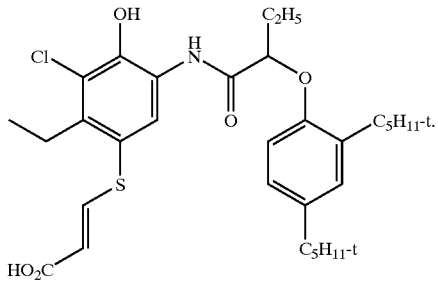
15. The photographic element of claim 2 in which a non-light sensitive antihalation layer is located between a layer containing the neutral silver-based image forming coupler and all color dye-forming layers.

16. The photographic element of claim 15 in which the layer containing the neutral silver-based image forming coupler is located between the antihalation layer and the support.

17. The photographic element of claim 15 in which the support is located between the layer containing the neutral silver-based image forming coupler and the antihalation layer.

18. The element of claim 1 wherein the thiovinyl group contains no more than 10 carbon atoms.

19. A method for recording and processing multicolor subject image area frames and an optical soundtrack image outside the frame area in a motion picture film, comprising:

a) providing a support bearing blue, green, and red light sensitive silver halide emulsion dye forming layers and a further light sensitive layer containing a neutral silver-based image forming coupler which, upon reaction with oxidized color developer, releases a thiovinyl group that reacts to form the neutral silver-based image;

b) imagewise exposing said color subject image forming emulsion layers within the image area frame;

c) exposing the neutral silver-based image forming layer outside the subject image area frame in accordance with an analog soundtrack; and d) processing the exposed film to develop the color subject image and the soundtrack neutral silver-based image in a single process to yield corresponding dye images in the exposed image area frame and a neutral silver-based outside the subject image area frame.

* * * * *